US009152085B2

(12) United States Patent
Hayashi et al.

(10) Patent No.: US 9,152,085 B2
(45) Date of Patent: Oct. 6, 2015

(54) DEVELOPING DEVICE AND IMAGE FORMING APPARATUS INCLUDING THE SAME

(71) Applicant: KYOCERA DOCUMENT SOLUTIONS INC., Osaka (JP)

(72) Inventors: Masaki Hayashi, Osaka (JP); Yoshihiro Yamagishi, Osaka (JP); Hiroshi Yamazaki, Osaka (JP); Koji Kuramashi, Osaka (JP); Eiji Nimura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 120 days.

(21) Appl. No.: 13/681,668

(22) Filed: Nov. 20, 2012

(65) Prior Publication Data

US 2013/0156468 A1 Jun. 20, 2013

(30) Foreign Application Priority Data

Dec. 19, 2011 (JP) ..... 2011-277258

(51) Int. Cl.
*G03G 15/08* (2006.01)

(52) U.S. Cl.
CPC ..... *G03G 15/0889* (2013.01); *G03G 15/0893* (2013.01)

(58) Field of Classification Search
CPC ..... G03G 15/0839; G03G 15/0889; G03G 15/0891; G03G 15/0887; G03G 15/0877; G03G 15/0829; G03G 2215/0822; G03G 2215/0838; G03G 2215/085; G03G 2215/0827; G03G 2215/0819
See application file for complete search history.

(56) References Cited

U.S. PATENT DOCUMENTS

| | | | | |
|---|---|---|---|---|
| 4,436,411 | A * | 3/1984 | Miyoshi et al. | 399/29 |
| 5,581,337 | A * | 12/1996 | Suzuki | 399/263 |
| 7,558,513 | B2 * | 7/2009 | Sugimoto et al. | 399/254 |
| 2007/0264051 | A1 * | 11/2007 | Tanaka | 399/254 |
| 2007/0274741 | A1 * | 11/2007 | Shiraishi et al. | 399/254 |
| 2009/0214268 | A1 * | 8/2009 | Noh et al. | 399/258 |
| 2011/0013943 | A1 * | 1/2011 | Sakamoto et al. | 399/254 |
| 2012/0243913 | A1 * | 9/2012 | Murata et al. | 399/263 |

FOREIGN PATENT DOCUMENTS

| | | |
|---|---|---|
| JP | 2008-039986 | 2/2008 |
| JP | 2008039986 A * | 2/2008 |

* cited by examiner

*Primary Examiner* — Clayton E Laballe
*Assistant Examiner* — Victor Verbitsky
(74) *Attorney, Agent, or Firm* — Morgan, Lewis & Bockius LLP

(57) ABSTRACT

A developing device includes a first agitating member and a second agitating member. Each of the first and second agitating members includes a screw having a helical portion formed helically so as to define a hollow portion, and a plurality of ribs formed on the helical portion in the longitudinal direction of the screw. On at least one of the first and second agitating members, there is disposed a paddle opposed to the communicating portion on a downstream side in a transport direction of the developing powder. The paddle has a flat surface in a direction perpendicular to the longitudinal direction, and a width of a distal end of the paddle is smaller than a width of a proximal end of the paddle disposed to the agitating member in a plan view.

9 Claims, 7 Drawing Sheets

DEVELOPING DEVICE AND IMAGE FORMING APPARATUS INCLUDING THE SAME

CROSS-REFERENCE TO RELATED APPLICATIONS

This application is based on and claims the benefit of priority from Japanese Patent Application No. 2011-277258 filed on Dec. 19, 2011, the contents of which are hereby incorporated by reference.

BACKGROUND

The present disclosure relates to a developing device used for a copier, a printer, a facsimile, a multifunctional peripheral thereof, and the like, and to an image forming apparatus including the same.

There is known a developing device having a structure in which two transport paths extending close to each other in parallel are disposed for circulating and agitating developing powder, and the developing powder is circulated in the two transport paths by agitating members disposed in the individual transport paths. In this developing device, partition walls are opened to form communicating portions on both ends in a longitudinal direction of the two transport paths so that the developing powder circulates in the two transport paths. The developing powder is transported by the agitating member in the longitudinal direction in the transport path. In order to transport the developing powder to the other transport path, it is necessary to transport the developing powder in the communicating portion in a direction perpendicular to the transport direction in the transport path. When the transport direction of the developing powder is largely changed in the communicating portion in this way, the developing powder may stagnate in the communicating portion.

Therefore, there is known a developing device to resolve the stagnation of the developing powder in the communicating portion. The developing device includes communicating portions opening both ends in the longitudinal direction of the neighboring first and second transport paths, and agitating members disposed in the transport paths for agitating the developing powder to transport the same in the transport paths in the longitudinal direction. The agitating member includes a helical screw disposed on a rotation shaft portion, and a rectangular flat plate paddle disposed to the rotation shaft portion to be opposed to the communicating portion. When the screw rotates, the developing powder is transported in the transport path in the longitudinal direction, and the developing powder is transported from the transport path to the communicating portion by rotation of the paddle. By disposing the paddle to the agitating member in this way, stagnation of the developing powder in the communicating portion is resolved.

However, in the above-mentioned developing device, when the developing powder such as magnetic toner having a relatively low fluidity is agitated and is transported in the transport path in the longitudinal direction, the developing powder may be coagulated by frictional heat between the agitating member and the developing powder. When the developing powder is transported from one of the transport paths to the other transport path via the communicating portion by rotation of the paddle, the coagulated developing powder may adhere to the paddle, or the coagulated developing powder may adhere to the side end surface of the paddle formed in a rectangular shape. As a result, there is an inconvenience that the developing powder can be hardly transported smoothly in the communicating portion.

SUMMARY

It is an object of the present disclosure to provide a developing device and an image forming apparatus including the same, in which fluidity of the developing powder in the transport path is improved, and the developing powder can be smoothly transported in the communicating portion between the two transport paths.

A developing device according to an aspect of the present disclosure includes a first transport path in which developing powder is transported in a predetermined direction, a second transport path in which the developing powder is transported in the opposite direction to the first transport path, extending in parallel and adjacent to the first transport path, a partition member which partitions between the first and second transport paths, communicating portions in which both ends in a longitudinal direction of the partition member are opened so that the developing powder can circulates in the first and second transport paths, a first agitating member disposed in the first transport path so as to agitate the developing powder and to transport the same in the first transport path in the longitudinal direction, and a second agitating member disposed in the second transport path so as to agitate the developing powder and to transport the same in the second transport path in the longitudinal direction. Each of the first and second agitating members includes a screw having a helical portion formed helically extending in each of the first and second transport paths in the longitudinal direction so as to define a hollow portion, and a plurality of ribs formed on the helical portion in the longitudinal direction of the screw. On at least one of the first and second agitating members, there is disposed a paddle opposed to the communicating portion on a downstream side in a transport direction of the developing powder. The paddle has a flat surface in a direction perpendicular to the longitudinal direction, and a width of a distal end of the paddle is smaller than a width of a proximal end of the paddle disposed to the agitating member in a plan view.

Other objects of the present disclosure and specific advantages obtained by the present disclosure will become apparent from the description of embodiments given below.

DETAILED DESCRIPTION

Hereinafter an embodiment of the present disclosure is described with reference to the drawings, but the present disclosure is not limited to this embodiment. In addition, uses of the disclosure and terms described here are not limited.

Figure 1:
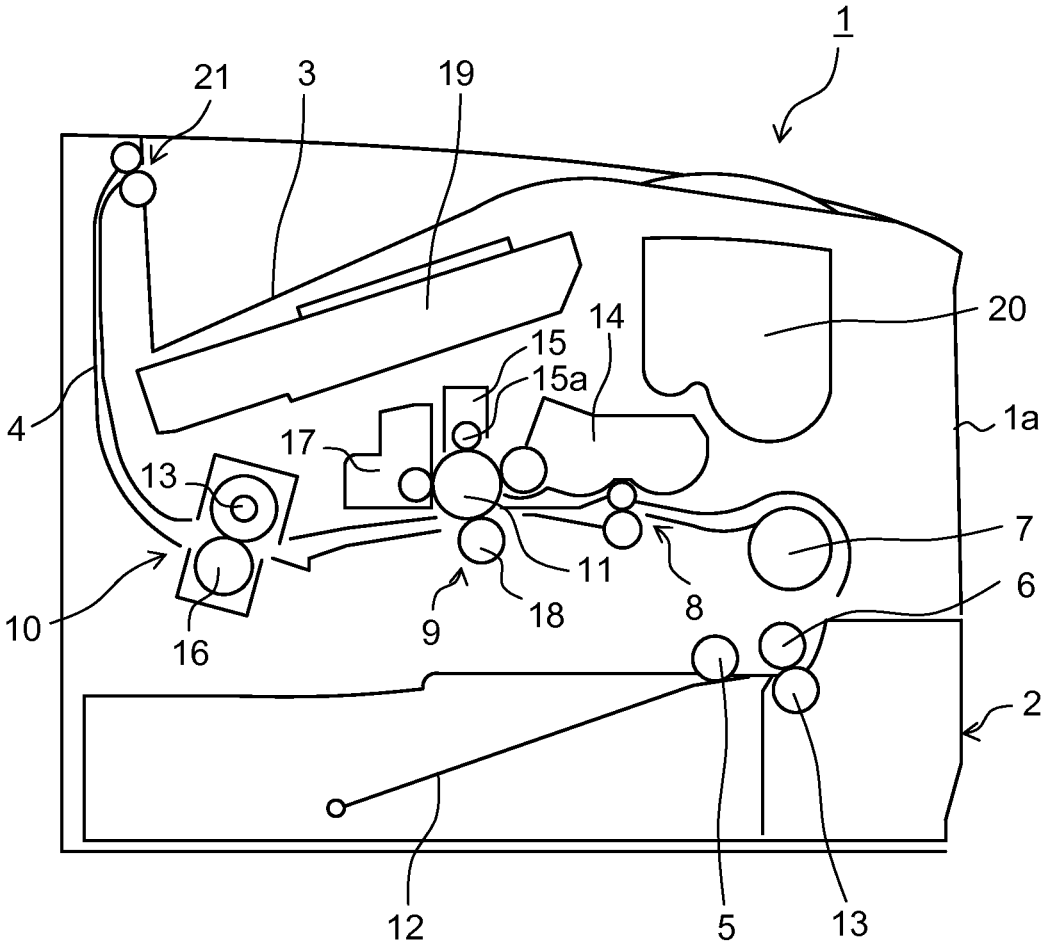
FIG. 1 is a cross-sectional view illustrating a schematic structure of an image forming apparatus as an embodiment of the present disclosure.

FIG. 1 is a cross-sectional view illustrating a schematic structure of an image forming apparatus as an embodiment of the present disclosure, in which the right side corresponds to the front of the image forming apparatus. In a lower part of an apparatus main body 1*a* of the image forming apparatus 1, there is disposed a sheet feed cassette 2 for storing stacked paper sheets. Above this sheet feed cassette 2, there is formed a paper sheet transport path 4 extending substantially in the horizontal direction from the front to the rear of the apparatus main body 1*a* and further extending upward to reach a paper discharge portion 3 formed on an upper surface of the apparatus main body 1*a*. Along this paper sheet transport path 4, there are disposed, in order from the upstream side, a pickup roller 5, a feed roller 6, an intermediate transport roller 7, a registration roller pair 8, an image forming portion 9, a fixing portion 10, and a discharge roller pair 21.

The sheet feed cassette 2 is equipped with a sheet stack tray 12 supported by the sheet feed cassette 2 in a rockable manner. Paper sheets stacked on the sheet stack tray 12 are sent out toward the paper sheet transport path 4 by the pickup roller 5. If a plurality of paper sheets are sent out simultaneously by the pickup roller 5, the feed roller 6 and a retard roller 13 separates the paper sheets so that only an uppermost paper sheet is transported. The paper sheet sent out to the paper sheet transport path 4 is changed in the transport direction to the rear of the apparatus main body 1*a* by the intermediate transport roller 7 and is transported to the registration roller pair 8. Then, the paper sheet is supplied to the image forming portion 9 after the registration roller pair 8 adjusts the timing.

The image forming portion 9 forms a predetermined toner image on the paper sheet by an electrophotography process. As illustrated in FIG. 1, the image forming portion 9 includes a photoreceptor drum 11 supported to be rotatable in a clockwise direction, and around this photoreceptor drum 11, there are disposed a charging portion 15, a developing device 14, a cleaning portion 17, a transfer roller 18 opposed to the photoreceptor drum 11 via the paper sheet transport path 4, and an optical scanning unit 19 disposed above the photoreceptor drum 11. Above the developing device 14, there is disposed a toner container 20 that supplies toner to the developing device 14.

The charging portion 15 is equipped with a conductive rubber roller 15*a*. The conductive rubber roller 15*a* is disposed to contact with the photoreceptor drum 11. Further, when the photoreceptor drum 11 rotates, the conductive rubber roller 15*a* contacts with a surface of the photoreceptor drum 11 and follows to rotate. Then, a predetermined voltage is applied to the conductive rubber roller 15*a* so that the surface of the photoreceptor drum 11 is uniformly charged.

Next, a light beam based on image data from the optical scanning unit 19 irradiates the photoreceptor drum 11 so that an electrostatic latent image is formed on the photoreceptor drum 11. The toner supplied from the developing device 14 adheres to the electrostatic latent image so that a toner image is formed on the surface of the photoreceptor drum 11. Then, a paper sheet is supplied from the registration roller pair 8 to a transfer nip portion constituted of the photoreceptor drum 11 and the transfer roller 18 at a predetermined timing, and hence the transfer roller 18 transfers the toner image on the surface of the photoreceptor drum 11 onto the paper sheet.

The paper sheet with the transferred toner image is separated from the photoreceptor drum 11 and is transported toward the fixing portion 10. The fixing portion 10 is disposed on the downstream side of the image forming portion 9 in a paper sheet transport direction and includes a heat roller 13 that is heated by a heating means such as a heater, and a pressure roller 16 that is pressed to contact with the heat roller 13. The paper sheet onto which the toner image is transferred by the image forming portion 9 is heated and pressed by the heat roller 13 and the pressure roller 16 so that the toner image transferred onto the paper sheet is fixed.

The paper sheet on which the image is formed is discharged by the discharge roller pair 21 to the paper discharge portion 3. On the other hand, toner remaining on the surface of the photoreceptor drum 11 after the transfer process is removed by the cleaning portion 17, and the photoreceptor drum 11 is charged again by the charging portion 15. After that, image formation is performed in the same manner.

Figure 2:
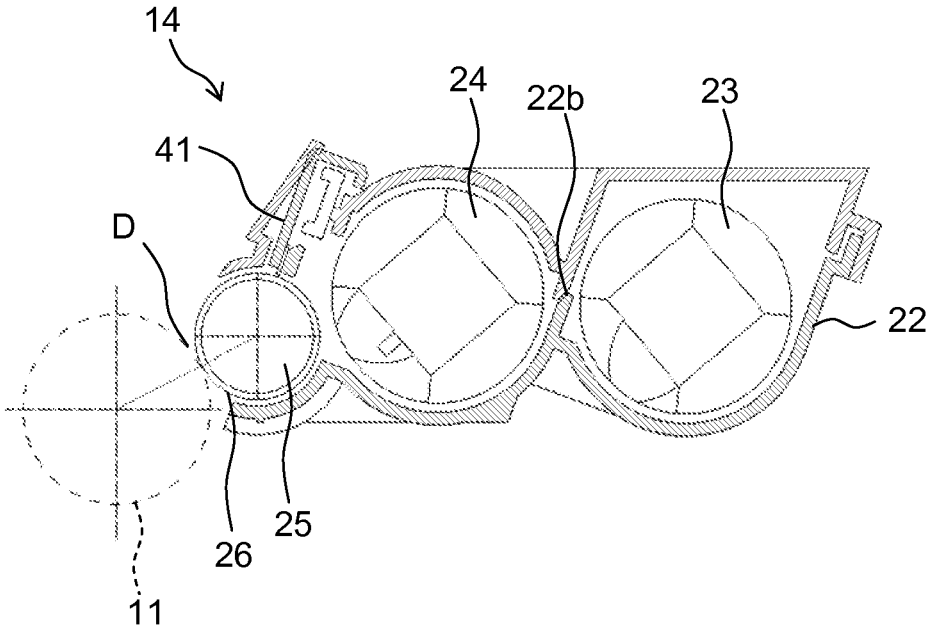
FIG. 2 is a cross-sectional view illustrating a schematic structure of a developing device according to the embodiment of the present disclosure.

FIG. 2 is a cross section illustrating a schematic structure of the developing device 14 used for the above-mentioned image forming apparatus 1.

The developing device 14 includes a developing container 22 that stores single component magnetic developing powder, a first agitating member 23 and a second agitating member 24 for agitating and transporting the developing powder (hereinafter may be referred to as "toner"), a developing roller constituted of a developing sleeve 26 and a magnetic pole member 25, and a restriction member 41.

The first and second agitating members 23 and 24 are disposed in a rotatable manner in the developing container 22 so as to sandwich the partition member 22*b*. In addition, the first and second agitating members 23 and 24 have screws formed helically in an axial direction. When the first and second agitating members 23 and 24 rotate, the toner is agitated. The agitated toner circulates through communicating portions 22*e* and 22*f* (see FIG. 3) formed on both ends of the partition member 22*b* in the developing container 22 in the longitudinal direction (front and rear direction of paper of FIG. 2), and the toner is charged by friction among toner particles. Further, the toner is supplied to the developing sleeve 26 by the second agitating member 24.

The developing sleeve 26 is formed of non-magnetic material such as aluminum in a cylindrical shape and includes a built-in magnetic pole member 25. In addition, the developing sleeve 26 is supported in the developing container 22 in a rotatable manner at a position adjacent to the second agitating member 24. In addition, the developing sleeve 26 is exposed from an opening of the developing container 22 and is opposed to the photoreceptor drum 11 as an image carrier with a certain space. In this opposed area, there is formed a developing area D for supplying the toner carried by the developing sleeve 26 to the photoreceptor drum 11.

The magnetic pole member 25 has a plurality of magnetic pole portions in the circumferential direction, which generate magnetic fields toward a surface of the developing sleeve 26 so that the charged toner is carried by the surface of the developing sleeve 26.

The restriction member 41 restricts the toner carried by the surface of the developing sleeve 26 to have a predetermined layer thickness. The restriction member 41 has a blade-like shape and is attached to the developing container 22 on an upstream side of the developing area D in a rotation direction of a rotation sleeve 26 with a predetermined space to the surface of the developing sleeve 26.

The toner supplied from the second agitating member 24 is carried by the surface of the developing roller 26, and the carried toner is restricted to have a certain layer thickness by the restriction member 41, and is further transported toward the developing area D by rotation of the developing roller 26. Because a predetermined bias voltage is applied to the developing roller 26, a potential difference is generated between the developing roller 26 and the photoreceptor drum 11. In the developing area D, the toner on the developing roller 26 is supplied to the photoreceptor drum 11, and the electrostatic latent image on the photoreceptor drum 11 is developed to be the toner image.

Figure 3:
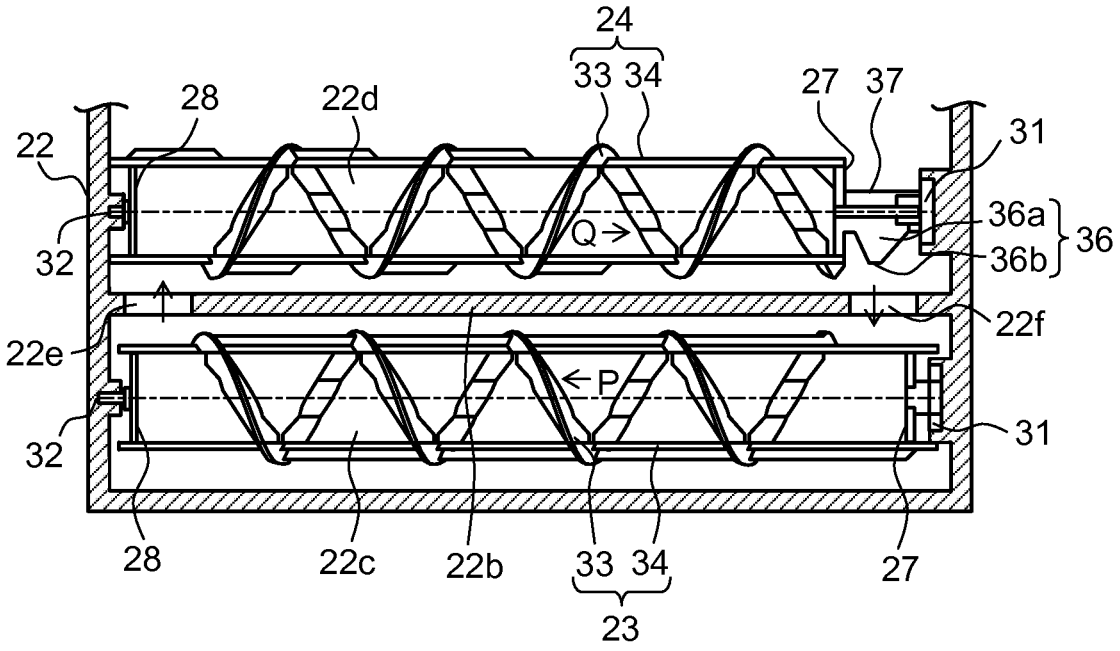
FIG. 3 is a plan cross-sectional view illustrating an agitating portion of the developing device according to the embodiment of the present disclosure.

Next, with reference to FIG. 3, the agitating portion of the developing device 14 is described specifically. FIG. 3 is a plan cross-sectional view of the agitating portion viewed from the top.

In the developing container 22, there are formed a first transport path 22*c*, a second transport path 22*d*, the partition member 22*b*, the first communicating portion 22*e*, and the second communicating portion 22*f*.

The partition member 22*b* extends in the longitudinal direction of the developing container 22 so as to partition between the first transport path 22*c* and the second transport path 22*d* to be in parallel. At a left side end of the partition member 22*b* in the longitudinal direction, the partition member 22*b* forms the first communicating portion 22*e* together with a side wall portion of the developing container 22. On the other hand, at a right side end of the partition member 22*b* in the longitudinal direction, the partition member 22*b* forms the second communicating portion 22*f* together with the side wall portion of the developing container 22. The first and second communicating portions 22*e* and 22*f* are opened so that the toner can move between the first transport path 22*c* and the second transport path 22*d*. Therefore, the toner can circulate in the first transport path 22*c*, the first communicating portion 22*e*, the second transport path 22*d*, and the second communicating portion 22*f*.

The first agitating member 23 is disposed in the first transport path 22*c*, and the second agitating member 24 is disposed in the second transport path 22*d*.

The first agitating member 23 includes rotation shafts 31 and 32 supported by the side wall portion of the developing container 22 respectively in a rotatable manner, flange portions 27 and 28 formed integrally to the rotation shafts 31 and 32, respectively, a screw 33 that extends helically at a certain pitch in a direction of axes of the rotation shafts 31 and 32 between the flange portions 27 and 28 and is formed in a hollow, and a pair of ribs 34 for supporting the screw 33 in a rotatable manner without decentering from axes of the rotation shafts 31 and 32 when rotating. The screw 33 and the rib 34 are disposed to extend in the longitudinal direction of the first transport path 22*c*.

The second agitating member 24 includes rotation shafts 31 and 32 supported by the side wall portion of the developing container 22 respectively in a rotatable manner, flange portions 27 and 28 formed integrally to the rotation shafts 31 and 32, respectively, a screw 33 that extends helically at a certain pitch in a direction of axes of the rotation shafts 31 and 32 between the flange portions 27 and 28 and is formed in a hollow, and a pair of ribs 34 for supporting the screw 33 in a rotatable manner without decentering from axes of the rotation shafts 31 and 32 when rotating. The screw 33 of the second agitating member 24 is constituted to have the same pitch but the opposite direction of phase to the screw 33 of the first agitating member 23. The screw 33 and the rib 34 of the second agitating member 24 are disposed to extend in the longitudinal direction of the second transport path 22*d*. Further, the second agitating member 24 includes a paddle 36 at a position opposed to the second communicating portion 22*f*. Note that details of the paddle 36 are described later.

When the first and second agitating members 23 and 24 are rotated in the same direction by a drive source such as a motor and gears (not shown), the screw 33 of the first agitating member 23 rotates in a predetermined direction so that the toner is agitated and transported in a direction of arrow P in the first transport path 22*c* by rotation of the screw 33. When the toner is transported in the first transport path 22*c*, the agitated toner is transported appropriately while being dispersed around an outer edge portion and in a hollow portion of the screw 33, and then is transported to the inside of the second transport path 22*d* through the first communicating portion 22*e*. In addition, the screw 33 of the second agitating member 24 is rotated in a predetermined direction, and the toner is agitated and transported in a direction of arrow Q in the second transport path 22*d* by rotation of the screw 33. When the toner is transported in the second transport path 22*d*, the agitated toner is dispersed around an outer edge portion and in a hollow portion of the screw 33 while being transported appropriately, and further is transported to the first transport path 22*c* through the second communicating portion 22*f*. In this way, the toner circulates in the first transport path 22*c*, the first communicating portion 22*e*, the second transport path 22*d*, and the second communicating portion 22*f* in order and is agitated. The agitated toner is supplied to the developing sleeve 26 (see FIG. 2).

Figure 4A:
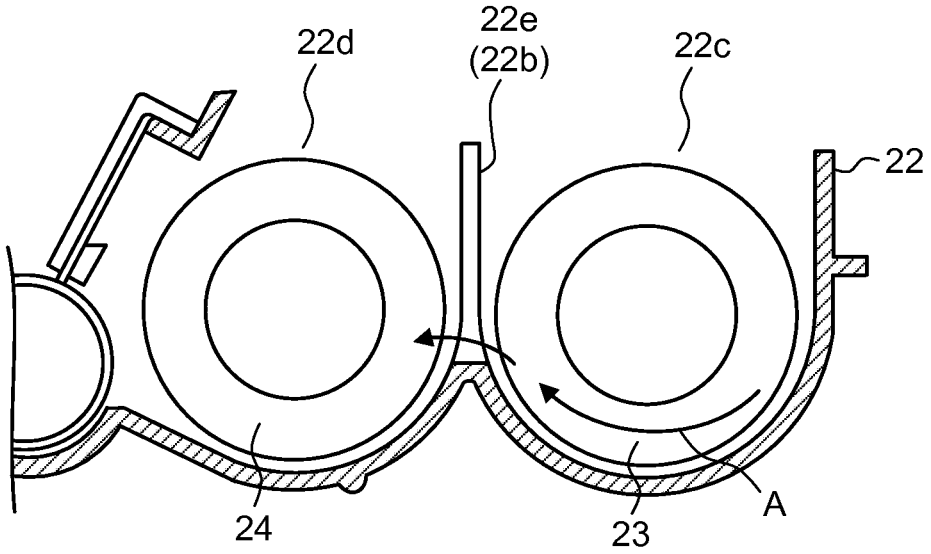
FIG. 4A is a cross-sectional view illustrating a transporting state of the developing powder in a first communicating portion of the developing device according to the embodiment of the present disclosure.
Figure 4B:
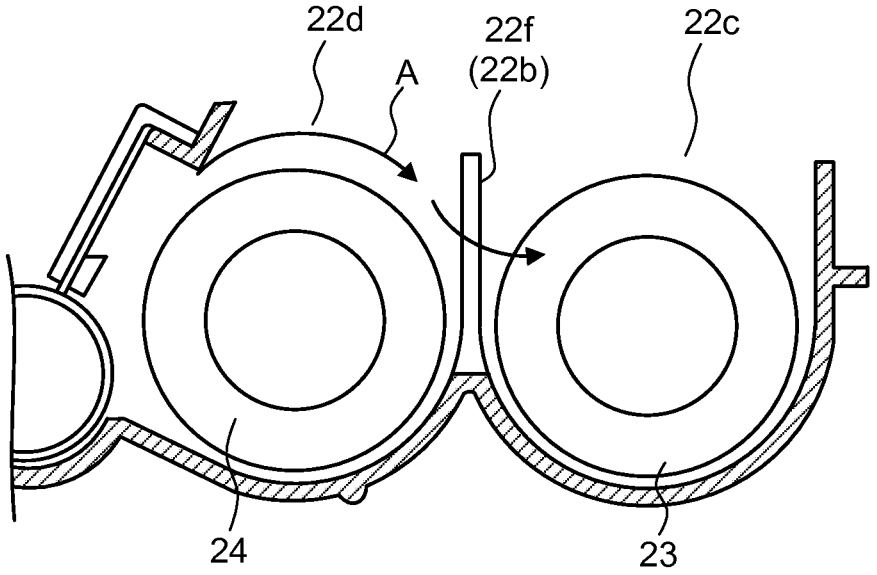
FIG. 4B is a cross-sectional view illustrating a transporting state of the developing powder in a second communicating portion of the developing device according to the embodiment of the present disclosure.

In the first and second communicating portions 22*e* and 22*f*, as illustrated in FIGS. 4A and 4B, the toner is transported from one of the first and second transport paths 22*c* and 22*d* to the other transport path. FIG. 4A is a cross-sectional view illustrating a state where the toner is transported from the first transport path 22*c* to the second transport path 22*d* in the first communicating portion 22*e*, and FIG. 4B is a cross-sectional view illustrating a state where the toner is transported from the second transport path 22*d* to the first transport path 22*c* in the second communicating portion 22*f*.

As illustrated in FIG. 4A, in the first communicating portion 22*e*, the first agitating member 23 rotates in a direction of arrow A, and the toner is transported from the first transport path 22*c* to the second transport path 22*d* through the first communicating portion 22*e*. In this case, the first agitating member 23 rotates in the direction approaching the first communicating portion 22*e* (partition member 22*b*) from the lower side in the first transport path 22*c*, and hence the toner in the lower side (bottom part) in the first transport path 22*c* is transported to the second transport path 22*d* through the first communicating portion 22*e*. In this way, when the toner is transported from the lower side (bottom part) in the transport path through the communicating portion, the toner can be transported relatively smoothly to the communicating portion.

On the other hand, as illustrated in FIG. 4B, in the second communicating portion 22*f*, the second agitating member 24 rotates in the direction of arrow A (in the same rotation direction as the first agitating member 23) so that the toner is transported from the second transport path 22*d* to the first transport path 22*c* through the second communicating portion 22*f*. In this case, the second agitating member 24 rotates in the direction approaching the second communicating portion 22*f* (partition member 22*b*) from the upper side in the second transport path 22*d*, and hence the toner in the upper side in the second transport path 22*d* is transported to the first transport path 22*c* through the second communicating portion 22*f*. In this way, when the toner is transported from the upper side of the transport path 22 through the communicating portion, the transport ability of the toner is lower than that in the case where the toner is transported from the lower side (bottom part) in the transport path. Therefore, in this embodiment, the paddle 36 (see FIG. 3) is disposed at a position opposed to the second communicating portion 22*f* of the second agitating member 24 so that the transport ability of the toner is improved.

With reference to FIG. 3 again, at a link portion 37 disposed between the flange portion 27 of the second agitating member 24 and the rotation shaft 31, there is formed the paddle 36. The paddle 36 has a flat surface in a direction perpendicular to an axial direction of the rotation shaft 31 (longitudinal direction), and the flat surface is formed in a trapezoidal shape. In other words, the paddle 36 is formed to have a large width in the axial direction at the proximal end 36*a* on the link portion 37 side, and a shorter width in the axial direction at the distal end 36*b* than the width at the proximal end 36*a* in a plan view. When the toner is transported from the second transport path 22*d* to the first transport path 22*c* through the second communicating portion 22*f* by rotation of the paddle 36, even if coagulated toner is transported from the second transport path 22*d*, the slanting side end surface of the paddle 36 between the proximal end 36*a* and the distal end 36*b* breaks the coagulated toner. Thus, the coagulated toner is not retained by the paddle 36 so that the toner can be smoothly transported. Note that instead of the structure in which one paddle is disposed on an outer periphery of the link portion 37, it is possible to adopt a structure in which a plurality of paddles 36 are disposed. For instance, two paddles 36 may be disposed on the outer periphery of the link portion 37 in a manner of axial symmetry.

Figure 5A:
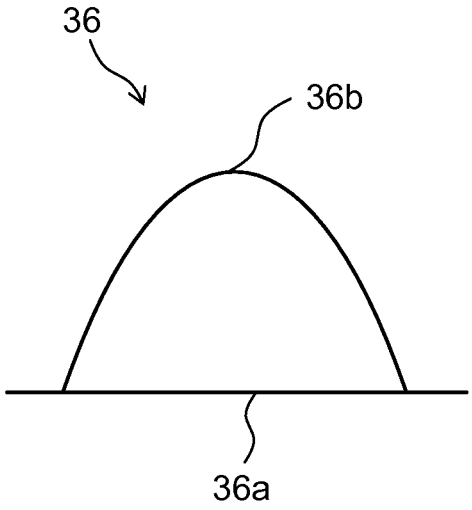
FIG. 5A is a plan view illustrating a variation example of a paddle of the agitating member according to the embodiment of the present disclosure.
Figure 5B:
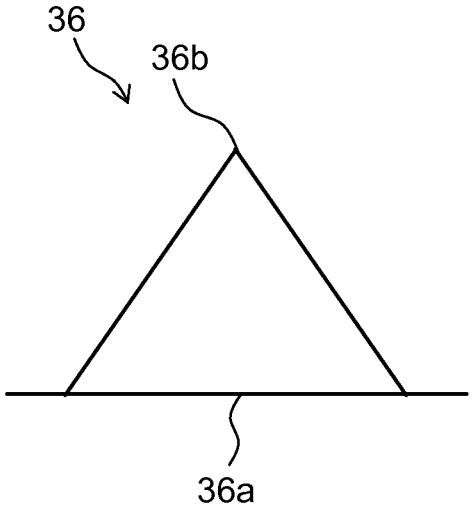
FIG. 5B is a plan view illustrating another variation example of the paddle of the agitating member according to the embodiment of the present disclosure.

As a shape of the paddle 36, various shapes other than the trapezoidal shape illustrated in FIG. 3 can be adopted as long as the width at the distal end 36*b* is smaller than the width at the proximal end 36*a* in a plan view. FIGS. 5A and 5B illustrate variation examples of the paddle 36. FIG. 5A illustrates the paddle 36 having substantially an arc shape, in which the center side of the circle is the proximal end 36*a* and the circumference side is the distal end 36*b*. In addition, FIG. 5B illustrates the paddle 36 having a triangular shape, in which one side is the proximal end 36*a* and the vertex is the distal end 36*b*. The paddles 36 of these shapes also have the same effect as the one having the trapezoidal shape illustrated in FIG. 3.

Figure 6:
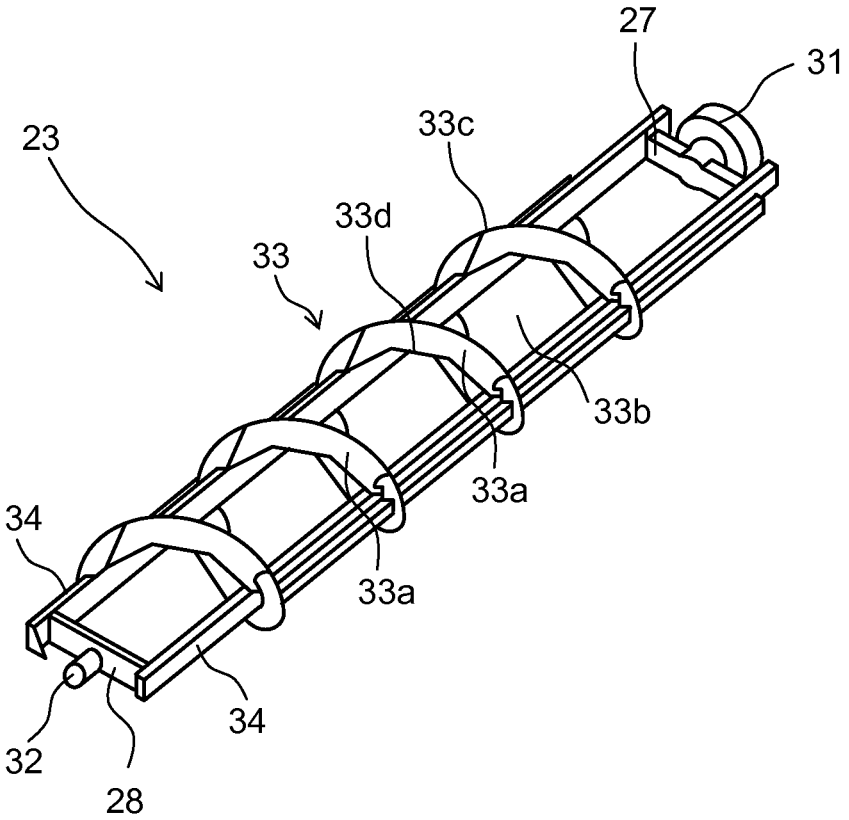
FIG. 6 is a perspective view illustrating a first agitating member according to the embodiment of the present disclosure.
Figure 7:
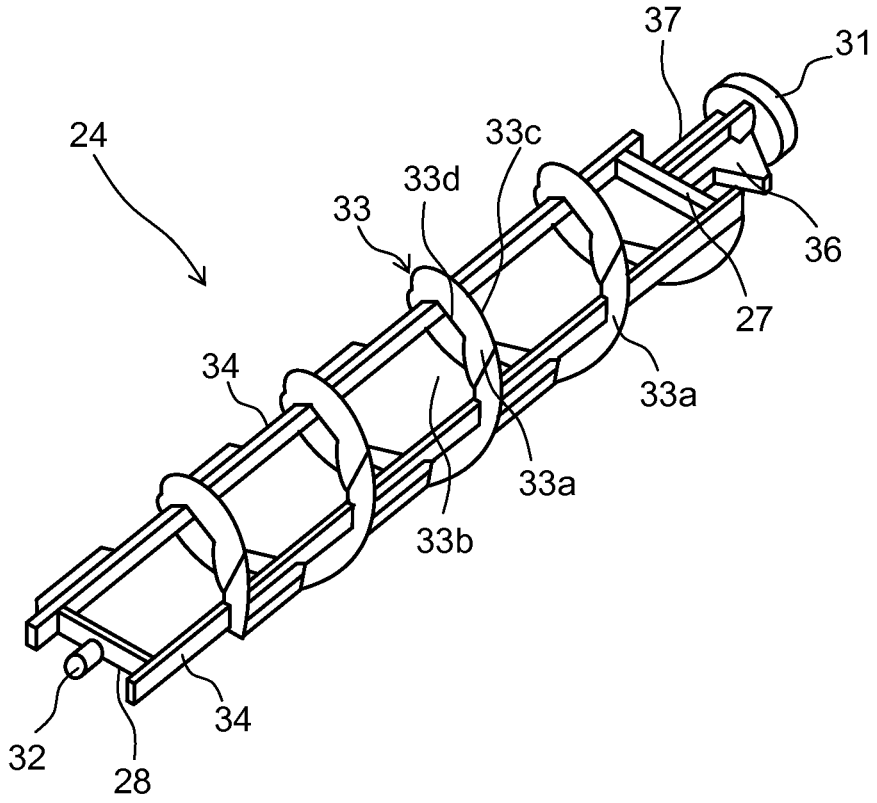
FIG. 7 is a perspective view illustrating a second agitating member according to the embodiment of the present disclosure.

FIGS. 6 and 7 illustrate detailed structures of the first and second agitating members 23 and 24. FIG. 6 is a perspective view illustrating a structure of the first agitating member 23, and FIG. 7 is a perspective view of a structure of the second agitating member 24.

As illustrated in FIG. 6, the first agitating member 23 includes a screw 33, a pair of ribs 34, rod-like flange portions 27 and 28, and rotation shafts 31 and 32, which are integrally made of resin such as ABS to which the toner hardly adheres.

The screw 33 includes a helical portion 33*a* formed to extend like a helical blade in the axial direction of the rotation shafts 31 and 32. The helical portion 33*a* has an outer edge portion 33*c* formed in a circular shape and an inner edge portion 33*d* formed in a polygon shape such as an octagon defining a hollow portion 33*b*. The helical portion 33*a* is constituted to have a small thickness (length in the longitudinal direction) at the outer edge portion 33*c*, which becomes larger as being close to the inner edge portion 33*d*.

The rib 34 is formed between opposed surfaces of the neighboring helical portions 33*a* and 33*a*. The rib 34 is formed to have a cross section shaped substantially like a triangle along the inner edge portion 33*d* of the helical portion 33*a*. A pair of the ribs 34 are formed at symmetric positions with respect to a straight line passing through axes of the rotation shafts 31 and 32. The pair of ribs 34 are formed between all opposed surfaces of the helical portions 33*a* and 33*a*, and are further formed to extend from the helical portion 33*a* to both end portions in the longitudinal direction so as to be connected to the flange portions 27 and 28, respectively. Note that it is possible to dispose three or more ribs 34.

The flange portion 27 is formed in a rod-like shape extending in a radial direction of the rotation shaft 31. A pair of ribs 34 is formed integrally to the flange portion 27 extending like a rod on both outer edges of the flange portion 27, and the flange portion 27 is formed integrally to the rotation shaft 31. The flange portion 28 is formed in a rod-like shape extending in a radial direction of the rotation shaft 32. A pair of ribs 34 is formed integrally to the flange portion 28 extending like a rod on both outer edges of the flange portion 28, and the flange portion 28 is formed integrally to the rotation shaft 32. Note that the helical portion 33*a* may be constituted to extend to the flange portions 27 and 28 in the longitudinal direction.

As illustrated in FIG. 7, the second agitating member 24 is constituted to include the screw 33, the pair of ribs 34, the rod-like flange portions 27 and 28, and the rotation shafts 31 and 32, which are integrally formed of a resin such as ABS to which the toner hardly adheres.

The screw 33 includes the helical portion 33*a* formed to extend like a helical blade in the axial direction of the rotation shafts 31 and 32. The helical portion 33*a* has the outer edge portion 33*c* having a circular shape and the inner edge portion 33*d* having a polygon shape such as an octagon defining the hollow portion 33*b*. The helical portion 33*a* is constituted to have a small thickness (length in the longitudinal direction) at the outer edge portion 33*c*, which becomes larger as being close to the inner edge portion 33*d*.

The rib 34 is formed between the opposed surfaces of the neighboring helical portions 33*a* and 33*a*. The rib 34 is formed to have a cross section shaped substantially like a triangle along the inner edge portion 33*d* of the helical portion 33*a*. A pair of the ribs 34 are formed at symmetric positions with respect to a straight line passing through axes of the rotation shafts 31 and 32. The pair of ribs 34 are formed between all opposed surfaces of the helical portions 33*a* and 33*a*, and are further formed to extend from the helical portion 33*a* to both end portions in the longitudinal direction so as to be connected to the flange portions 27 and 28, respectively. Note that it is possible to dispose three or more ribs 34.

The flange portion 27 is formed in a rod-like shape extending in a radial direction of the rotation shaft 31. A pair of ribs 34 is formed integrally to the flange portion 27 extending like a rod on both outer edges of the flange portion 27. Between the flange portion 27 and the rotation shaft 31, there is formed a link portion 37 extending in the axial direction of the rotation shaft 31 integrally to the rotation shaft 31 and the flange portion 27. The paddle 36 is formed on the link portion 37.

On the other hand, the flange portion 28 is formed in a rod-like shape extending in the radial direction of the rotation shaft 32. A pair of ribs 34 is formed integrally to the flange portion 28 extending like a rod on both outer edges of the flange portion 28, and the flange portion 28 is formed integrally to the rotation shaft 32.

Note that the helical portion 33*a* may be extended in the longitudinal direction to the flange portion 28.

Note that the embodiment described above shows the structure in which the paddle 36 is disposed on the downstream side of the second agitating member 24 in the toner transport direction, but the present disclosure is not limited to this structure. It is possible to dispose the paddle 36 only on the downstream side of the first agitating member 23 in the toner transport direction, or to dispose the same on each of the downstream sides of the first and second agitating members 23 and 24 in the toner transport direction. In this case, similarly to the embodiment described above, transport ability of the toner is improved, and it is possible to prevent the toner from being coagulated to be adhered and retained by the paddle 36. Thus, the toner can be smoothly transported.

In addition, the embodiment described above shows an example in which the present disclosure is applied to the screw 33 including the helical portion 33*a* formed helically defining the hollow portion 33*b*, but the present disclosure is not limited to this. It is possible to dispose the paddle 36 to the agitating member including the helical portion 33*a* formed on a shaft extending in the longitudinal direction in the transport path.

The present disclosure can be used for a copier, a printer, a facsimile, a multifunctional peripheral thereof, and the like, and to an image forming apparatus including the same.

What is claimed is:

1. A developing device comprising:

a developing roller;

a first transport path in which developing powder is transported in a predetermined direction;

a second transport path in which the developing powder is transported in the opposite direction to the first transport path, extending in parallel and adjacent to the first transport path;

a partition member which partitions between the first and second transport paths;

communicating portions in which both ends in a longitudinal direction of the partition member are opened so that the developing powder can circulates in the first and second transport paths;

a first agitating member disposed in the first transport path so as to agitate the developing powder and to transport the same in the first transport path in the longitudinal direction; and a second agitating member disposed in the second transport path so as to agitate the developing powder and to transport the same in the second transport path in the longitudinal direction, wherein the developing powder is a single component magnetic developing powder, each of the first and second agitating members includes a screw having a helical portion formed helically extending in each of the first and second transport paths in the longitudinal direction so as to define a hollow portion, and a plurality of ribs formed on the helical portion in the longitudinal direction of the screw, the second agitating member is disposed between the developing roller and the first agitating member, the second agitating member has a paddle opposed to the communicating portion on a downstream side in a transport direction of the developing powder, the paddle is disposed on a downstream side of the second agitating member a predetermined distance away from the helical portion in the transport direction of the developing powder, the paddle, the screw and the rib of the second agitating member are integrally formed with one another, the paddle has a flat surface in a direction perpendicular to the longitudinal direction, and a width of a distal end of the paddle is smaller than a width of a proximal end of the paddle disposed to the second agitating member in a plan view, the flat surface has a first side end and a second side end, the first side end connects the distal end of the paddle and the proximal end of the paddle to each other on an upstream side in the transport direction of the developing powder, the second side end connects the distal end of the paddle and the proximal end of the paddle to each other on the downstream side in the transport direction of the developing powder, and the first side end and the second side end slant with respect to the longitudinal direction in directions opposite to each other.

2. The developing device according to claim 1, wherein the paddle is formed in a trapezoidal shape in a plan view.

3. The developing device according to claim 1, wherein the paddle is formed in an arc shape in a plan view.

4. The developing device according to claim 1, wherein the paddle is formed in a triangular shape in a plan view.

5. The developing device according to claim 1, wherein each of the first and second agitating members further includes rotation shafts for being supported by the developing container at both end portions in the longitudinal direction in a rotatable manner, and flange portions having a rod-like shape extending in a radial direction of the rotation shaft so as to connect to the rib, and the paddle is formed on a link portion, which is disposed between the rotation shaft and the flange portion and is extending along the axial direction of the rotation shaft.

6. The developing device according to claim 1, wherein the paddle is formed of resin to which the developing powder hardly adheres.

7. An image forming apparatus comprising the developing device according to claim 1.

8. The developing device according to claim 1, wherein the first and second agitating members rotate in a same direction.

9. The developing device according to claim 1, wherein a slanting angle of the first side end to the longitudinal direction is larger than a slanting angle of the second side end to the longitudinal direction.

* * * * *